US005959600A

United States Patent [19]

Uchino et al.

[11] Patent Number: 5,959,600

[45] Date of Patent: Sep. 28, 1999

[54] ACTIVE MATRIX DISPLAY DEVICE

[75] Inventors: Katsuhide Uchino; Toshikazu Maekawa, both of Kanagawa, Japan

[73] Assignee: Sony Corporation, Tokyo, Japan

[21] Appl. No.: 08/629,563

[22] Filed: Apr. 9, 1996

[30] Foreign Application Priority Data

Apr. 11, 1995 [JP] Japan ..... 7-110179

[51] Int. Cl.[6] ..... G09G 3/36

[52] U.S. Cl. ..... 345/94; 345/100

[58] Field of Search ..... 345/55, 60, 74, 345/76, 78, 82, 90, 92, 94, 99, 100, 103, 197, 204, 208, 214, 215; 348/790, 791, 792, 793

[56] References Cited

U.S. PATENT DOCUMENTS

| | | | |
|---|---|---|---|
| 5,166,671 | 11/1992 | Maekawa | 345/100 |
| 5,252,957 | 10/1993 | Itakura | 345/98 |
| 5,426,447 | 6/1995 | Lee | 345/103 |
| 5,448,384 | 9/1995 | Uchino et al. | 345/92 |
| 5,532,713 | 7/1996 | Okada et al. | 345/97 |
| 5,686,936 | 11/1997 | Maekawa et al. | 345/100 |
| 5,694,145 | 12/1997 | Kondo et al. | 345/90 |
| 5,708,454 | 1/1998 | Katoh et al. | 345/100 |

FOREIGN PATENT DOCUMENTS

| | | |
|---|---|---|
| 0 541 364 A1 | 12/1993 | European Pat. Off. . |
| 0 622 772 A1 | 11/1994 | European Pat. Off. . |
| 0 678 848 A1 | 10/1995 | European Pat. Off. . |
| 0 678 849 A1 | 10/1995 | European Pat. Off. . |

*Primary Examiner*—Steven J. Saras
*Assistant Examiner*—John Suraci
*Attorney, Agent, or Firm*—Hill & Simpson

[57] ABSTRACT

An active matrix display device comprising row gate lines, column signal lines and matrix pixels disposed at intersections of the gate and signal lines. The display device also includes a V shift register for line-sequentially scanning the gate lines and selecting pixels of one row during each horizontal scanning period, and a horizontal scanning circuit for sequentially sampling an actual video signal to the signal lines within one horizontal scanning period and writing the sampled actual video signal dot-sequentially in the pixels of one row. A precharge means is included as a characteristic requisite, wherein a first precharge signal is supplied simultaneously to the entire signal lines during a blanking period which precedes the horizontal scanning period, and further a second precharge signal is supplied sequentially to the signal lines prior to the step of sequentially sampling the actual video signal to the signal lines during each horizontal scanning period. This device is capable of preventing potential fluctuation that may otherwise be caused on a signal line by dot-sequential driving.

17 Claims, 6 Drawing Sheets

ACTIVE MATRIX DISPLAY DEVICE

BACKGROUND OF THE INVENTION

The present invention relates to an active matrix display device and, more particularly, to a technique of preventing potential fluctuation on a video signal line in dot-sequential driving.

An exemplary construction of an active matrix display device in the related art will be briefly described below with reference to FIG. 6. This active matrix display device has row gate lines G, column signal lines S, and matrix liquid crystal pixels LC disposed at intersections of the gate lines and the signal lines. Each of the liquid crystal pixels LC is driven by a thin-film transistor Tr. A V shift register (vertical scanning circuit) 101 line-sequentially scans the gate lines G and selects liquid crystal pixels LC of one row during each horizontal scanning period (1H). An H shift register (horizontal scanning circuit) 102 sequentially samples a video signal to the signal lines S within a period of 1H and writes the video signal dot-sequentially in the selected liquid crystal pixels LC of one row. More specifically, the signal lines S are connected via horizontal switches HSW to a video line and are supplied with a video signal from a signal driver 103, while the H shift register 102 sequentially outputs horizontal sampling pulses H1, H2, H3, . . . , Hn to execute on-off control of the horizontal switches HSW.

FIG. 7 shows waveforms of sampling pulses. With improvements in attaining higher precision of the active matrix display device, the sampling rate is raised to consequently cause variation of the sampling pulse width $\tau_H$. In response to an output sampling pulse, the horizontal switch HSW corresponding thereto is turned on and off, so that a video signal from the video line is sampled and held to the corresponding signal line S. Since each signal line S has a capacitive component, charge and discharge are caused by such sampling of the video signal to eventually fluctuate the potential of the video line. With rise of the sampling rate, the sampling pulse width $\tau_H$ is varied as described above, so that the charge and discharge relative to each signal line S are not retained constant to thereby fluctuate the potential of the video line. And this phenomenon appears as a fixed pattern of vertical streaks to consequently bring about a problem that the definition of the displayed picture is extremely impaired. On a display conforming with the normal NTSC standard, the sampling rate is relatively low and a next sampling pulse falls after the video line potential begins to fluctuate, so that the preceding signal line is not affected harmfully and therefore none of fixed pattern of vertical streaks appears. However, in high-definition (HD) TV or double-speed NTSC, the sampling rate is extremely raised and it becomes difficult to achieve effective suppression of the potential fluctuation on the video line. Sampling pulses are produced in an H shift register consisting generally of thin-film transistors (TFTs). In a TFT, the mobility is lower than in a monocrystal transistor and variations of the physical constants are larger. Therefore it is difficult to precisely control the sampling pulses produced in this circuit. And in addition to the variation of the sampling pulse width, there also occurs some variation in the on-resistance of each horizontal switch HSW. Consequently the charge-discharge characteristics of the signal line S are varied to cause fluctuation of the video line potential, which is superposed on the actual video signal to eventually become vertical streaks, hence impairing the definition of the displayed picture conspicuously.

SUMMARY OF THE INVENTION

It is therefore an object of the present invention to realize effective suppression of potential fluctuation on a video line caused with increase of a sampling rate. For the purpose of achieving this object, the following means are contrived in the present invention. An active matrix display device of the invention fundamentally comprises row gate lines, column signal lines, and matrix pixels disposed at intersections of the gate lines and the signal lines. The display device also comprises a vertical scanning circuit for line-sequentially scanning the gate lines and selecting pixels of one row during each horizontal scanning period. The display device further comprises a horizontal scanning circuit for sequentially sampling a video signal to the signal lines within one horizontal scanning period and writing the video signal dot-sequentially in the selected pixels of one row. The characteristic requisite of the present invention is that a precharge means is incorporated, wherein a first precharge signal is supplied simultaneously to the entire signal lines during a blanking period which precedes a horizontal scanning period, and a second precharge signal is sequentially supplied, during the horizontal scanning period, to the signal lines prior to sequential sampling of the video signal relative to the signal lines. Preferably, the precharge means simultaneously supplies a first precharge signal having a predetermined potential, and then sequentially supplies a second precharge signal whose waveform is substantially the same as that of the video signal. In a concrete configuration, the precharge means comprises a plurality of switch means connected to the ends of the individual signal lines respectively, and a control means for executing on-off control of each switch means. The control means executes simultaneous on-off control of the switches during the blanking period to thereby supply the first precharge signal to the signal lines, and then executes sequential on-off control of the switches during the horizontal scanning period to thereby supply the second precharge signal to the signal lines.

According to the present invention, the configuration thereof is so contrived that the charge and discharge in each signal line are almost finished by the first and second precharge signals supplied in two steps, and the charge and discharge caused at the time of sampling the actual video signal are generated merely by the difference between the precharge level and the signal level. Therefore it becomes possible to suppress, in comparison with the prior art, the potential fluctuation on the video line from which the actual video signal is obtained, hence realizing elimination of the fixed vertical-streak pattern that raises a problem with regard to the definition of the displayed picture. In particular, two-step precharge is performed in such a manner that initially a first precharge signal is supplied simultaneously to the entire signal lines during the blanking period to execute rough charge and discharge. For this purpose, the first precharge signal has a fixed gray-level potential for example. Thereafter in the second step, a second precharge signal is supplied, during the horizontal scanning period, sequentially to the signal lines prior to the sequential sampling of the actual video signal to the signal lines, thereby executing fine charge and discharge. For this purpose, the second precharge signal is composed of a precharge video signal which is substantially the same in waveform as the actual video signal. In this manner, due to execution of rough and fine charges and discharges in two steps, the potential fluctuation on the video line can be remarkably suppressed. Supposing that there is executed only simultaneous precharge by the first gray-level precharge signal alone, in case the actual video signal is in the vicinity of a white level or a black level, a great potential difference is still caused by the gray level obtained due to the simultaneous precharge. Consequently, there occurs an unsatisfactory situation inadequate for suppressing the potential fluctuation on the video line. Meanwhile, if only dot-sequential precharge is executed by the second precharge signal alone, some potential fluctuation is caused by this precharge itself. More specifically, the gate line potential fluctuates because of the capacitive coupling, which is derived from the dot-sequential precharge, between the signal line and the gate line to consequently affect the signal line potential, hence inducing some deterioration of the picture such as shading. As mentioned, it is difficult to completely prevent degradation of the picture definition merely by either of the simultaneous precharge and the dot-sequential precharge, and the known disadvantages including such vertical streaks and shading can be eliminated by a combination of both precharge steps.

Furthermore, since the precharge video signal is written prior to the actual video signal, the on-time of each horizontal switch connected to the corresponding signal line is equivalently doubled, whereby other disadvantages such as ghost and deterioration of the resolution can also be reduced. When the on-resistance of each horizontal switch or the capacitance of each signal line is large and the sampling period of the actual video signal is extremely short, there may occur a situation where the precharge arrival level fails to be changed completely to the potential level of the actual video signal. For example, when simultaneous sampling is performed in a group of three signal lines, there occurs a phenomenon of ghost if the sampling period is extremely short. In respect of this point, the present invention is capable of suppressing such ghost since the on-time of each horizontal switch is equivalently doubled.

The above and other features and advantages of the present invention will become apparent from the following description which will be given with reference to the illustrative accompanying drawings.

DESCRIPTION OF THE PREFERRED EMBODIMENT

Figure 1:
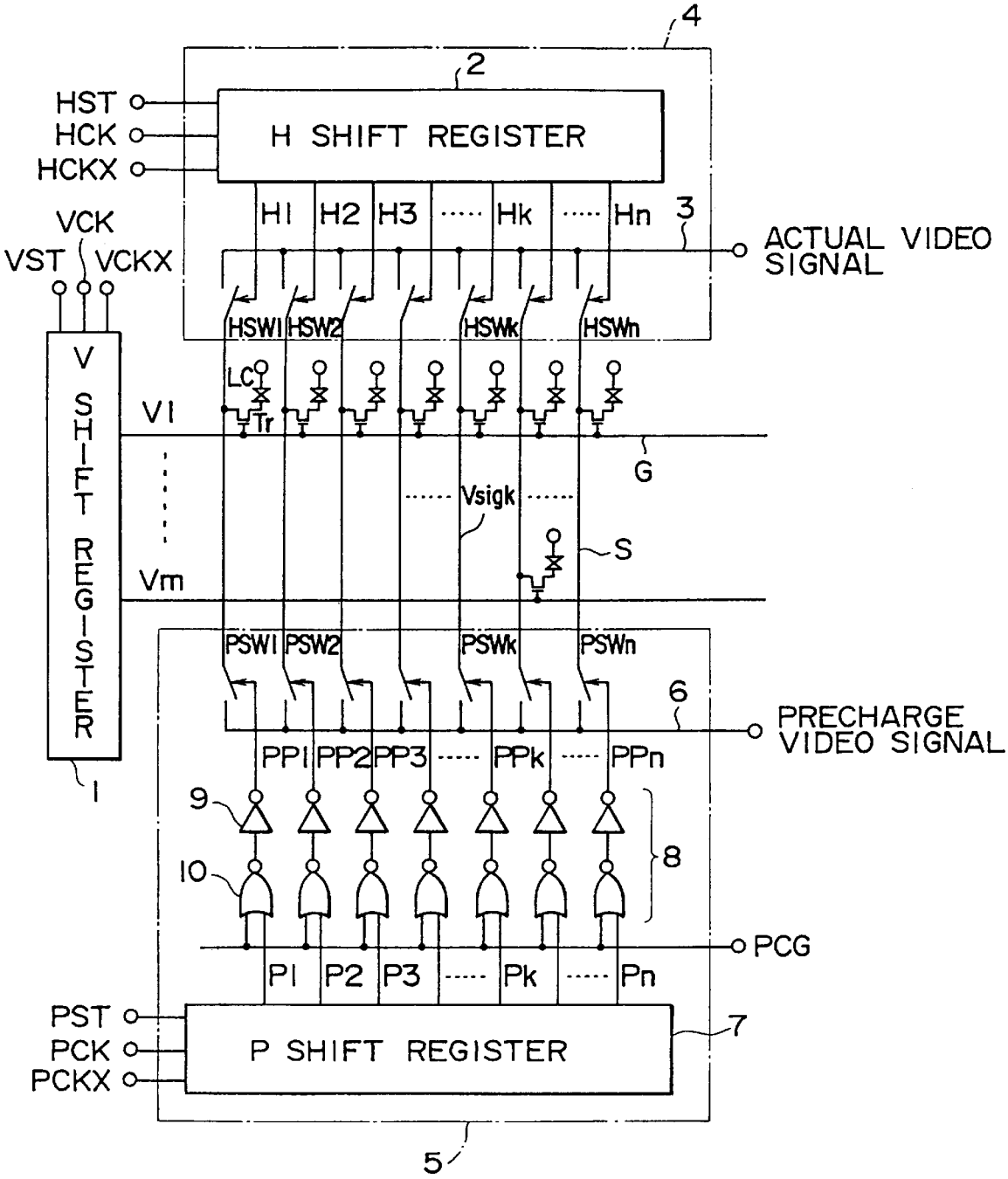
FIG. 1 is a block diagram showing a fundamental constitution of an active matrix display device of the present invention.

Hereinafter a preferred embodiment of the present invention will be described in detail with reference to the accompanying drawings. FIG. 1 is a circuit diagram of an embodiment representing the active matrix display device of the present invention. This device comprises row gate lines G, column signal lines S, and matrix liquid crystal pixels LC disposed at intersections of the gate lines and the signal lines. Although this embodiment uses pixels LC composed of liquid crystal as electro-optical material, the present invention is not limited to this example alone, and any other suitable electro-optical material may be employed as well. Driving thin-film transistors Tr are provided correspondingly to the individual liquid crystal pixels LC. A source electrode of each thin-film transistor Tr is connected to the corresponding signal line S, a gate electrode thereof is connected to the corresponding gate line G, and a drain electrode thereof to the corresponding liquid crystal pixel LC, respectively.

A V shift register 1 is provided to constitute a vertical scanning circuit for line-sequentially scanning the gate lines and selecting liquid crystal pixels LC of one row during each horizontal scanning period. More specifically, the V shift register 1 sequentially transfers a vertical start signal VST in synchronism with vertical clock signals VCK and VCKX which are mutually opposite in phase, and outputs select pulses V1, . . . , Vm to the gate lines G, whereby the thin-film transistors Tr are on-off controlled.

There is also provided an H shift register 2 for sequentially sampling an actual video signal to the signal lines S within one horizontal scanning period and writing the actual video signal dot-sequentially in the selected liquid crystal pixels LC of one row. More specifically, horizontal switches HSW1, HSW2, HSW3, . . . , HSWn are disposed at the ends of the signal lines S on one side and are connected to a video line 3 so as to be supplied with the actual video signal therefrom. Meanwhile the H shift register 2 sequentially transfers a horizontal start signal HST in synchronism with horizontal clock signals HCK and HCKX which are mutually opposite in phase, and outputs sampling pulses H1, H2, H3, . . . , Hn. These sampling pulses are applied to execute on-off control of the corresponding horizontal switches and then sample and hold the actual video signal to the individual signal lines S. In this manner, a horizontal scanning circuit 4 is constituted by a combination of the H shift register 2 and the horizontal switches HSW.

As one characteristic requisite of the present invention, there is provided a precharge means 5 for supplying a first precharge signal simultaneously to the entire signal lines S during a blanking period which precedes a horizontal scanning period, and further supplying, during the horizontal scanning period, a second precharge signal sequentially to the signal lines S prior to the sequential sampling of the video signal to the signal lines S. These first and second precharge signals are included in a precharge video signal and are supplied externally via a precharge line 6. Concretely, the precharge means 5 has precharge switches PSW1, PSW2, . . . , PSWn connected to the ends of the individual signal lines S respectively. The precharge means 5 further has a P shift register 7 for sequentially on-off controlling the precharge switches PSW to thereby supply a second precharge signal to the signal lines S. More concretely, the P shift register 7 is the same in structure as the H shift register 2, and transfers a horizontal start signal PST sequentially in synchronism with a pair of horizontal clock signals PCK and PCKX which are mutually opposite in phase, thereby outputting precharge sampling pulses P1, P2, P3, . . . , Pn. The horizontal switches PSW are on-off controlled sequentially in response to such precharge sampling pulses. Further a gate 8 is interposed between the P shift register 7 and the switch means consisting of the plural switches PSW. The gate 8 comprises series-connected inverter elements 9 and NOR gate elements 10 which are interposed between the respective stages of the P shift register 7 and the switches PSW corresponding thereto. One terminal of each NOR gate element 10 is supplied with a control signal PCG from an external circuit, and a first precharge signal is supplied simultaneously to the entire signal lines S in response to the control signal PCG. More specifically, on-off signals PP1, PP2, PP3, . . . , PPn formed by combining the output sampling pulses P of the P shift register 7 with the control signal PCG are applied to the switches PSW. In this manner, the P shift register 7 and the gate 8 constitute a control means, which executes simultaneous on-off control of the plural switches PSW in response to the control signal PCG outputted during a blanking period, and supplies the first precharge signal to the signal lines S. The control means further executes sequential on-off control of the plural switches PSW during a horizontal scanning period and supplies the second precharge signal to the signal lines S.

Figure 2:
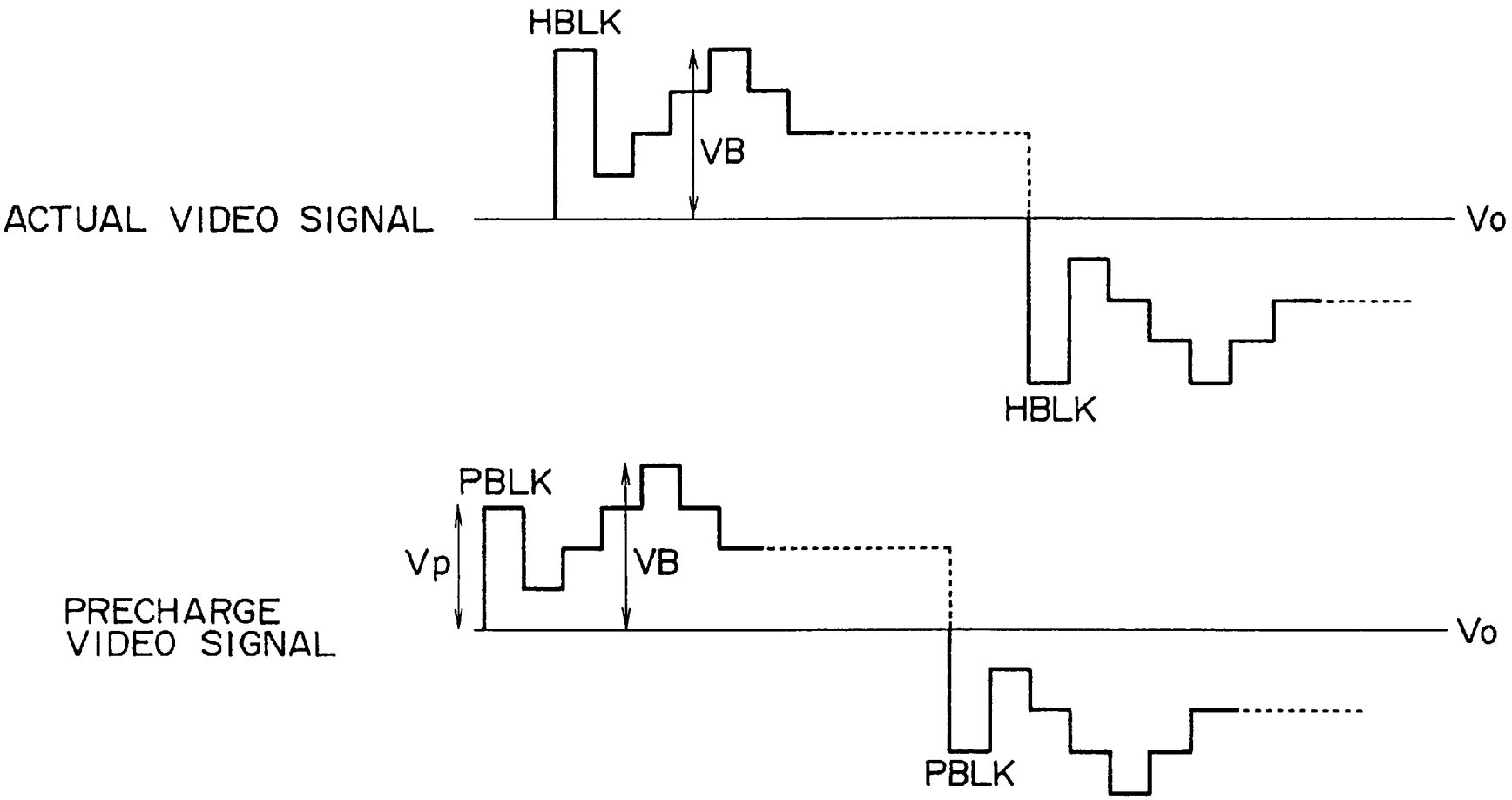
FIG. 2 is a waveform chart for explaining the operation of the active matrix display device shown in FIG. 1.

FIG. 2 is a typical waveform chart showing examples of an actual video signal and a precharge video signal. The polarity of the actual video signal is inverted per horizontal scanning period with respect to a predetermined reference potential Vo at the center. The maximum amplitude VB is, e.g., ±4.5V or so. In a normally white mode, black display is performed when the absolute value of VB is at its maximum level. In the actual video signal, a black level signal HBLK is included during a blanking period, and subsequently there follows the waveform to be actually written. The precharge video signal is substantially the same in waveform as the actual video signal. That is, the polarity of the precharge video signal is inverted per horizontal scanning period with respect to a reference voltage vo at the center. However, a level Vp of a signal PBLK included in a blanking period is set to an intermediate level, and it is used as a first precharge signal. The voltage Vp of the signal PBLK is set to, e.g., 2.5V or so in absolute value. The waveform following the signal PBLK is used as a second precharge signal.

Referring now to a timing chart of FIG. 3, a detailed description will be given on the operation of the active matrix display device shown in FIG. 1. First the control signal PCG supplied to the gate 8 is obtained from an external circuit during a blanking period in synchronism with the aforementioned first precharge signal PBLK. Thereafter the horizontal start signal PST is supplied externally to the P shift register 7. Further the horizontal start signal HST is supplied externally to the H shift register 2 after a certain delay time, which corresponds to predetermined pixels, from the signal PST. Horizontal clock signals PCK and PCKX are supplied to the P shift register 7, while horizontal clock signals HCK and HCKX are supplied to the H shift register 2. In this embodiment, the signals HCK and PCK are mutually the same in waveform as shown. Similarly the signals HCKX and PCKX are mutually the same in waveform, and have opposite-phase relationship to the signals HCK and PCK, respectively.

Regarding here the kth signal line X, its potential is denoted by Vsigk. Upon input of PST to the P shift register 7, it is sequentially transferred in accordance with PCK and PCKX, and a sampling pulse Pk corresponding to the kth signal line X is outputted at a certain timing. Similarly, HST inputted to the H shift register 2 is sequentially transferred in accordance with HCK and HCKX, and a sampling pulse Hk corresponding to the kth signal line S is outputted at a certain timing. The switch HSWk is actuated in response to Hk, and the actual video signal is sampled to the kth signal line. Prior to this operation, the switch PSWk corresponding thereto is actuated in response to the sampling pulse Pk, and the second precharge signal is sampled to the kth signal line. At this time, the OR gate 8 is existent between the switch PSWk and the P shift register 7. Therefore the OR of the kth output Pk of the P shift register 7 and the control signal PCG is taken, and finally PPk is supplied to PSW. Since PPk includes PCG outputted during the blanking period, the switches PSW are on-off controlled simultaneously. As a result, during the blanking period which precedes each horizontal scanning period, the first precharge signal PBLK is supplied simultaneously to the entire signal lines S. And subsequently, during the horizontal scanning period, the second precharge signal is supplied in sequence to the signal lines S prior to the sequential sampling of the actual video signal to the signal lines S.

Figure 3:
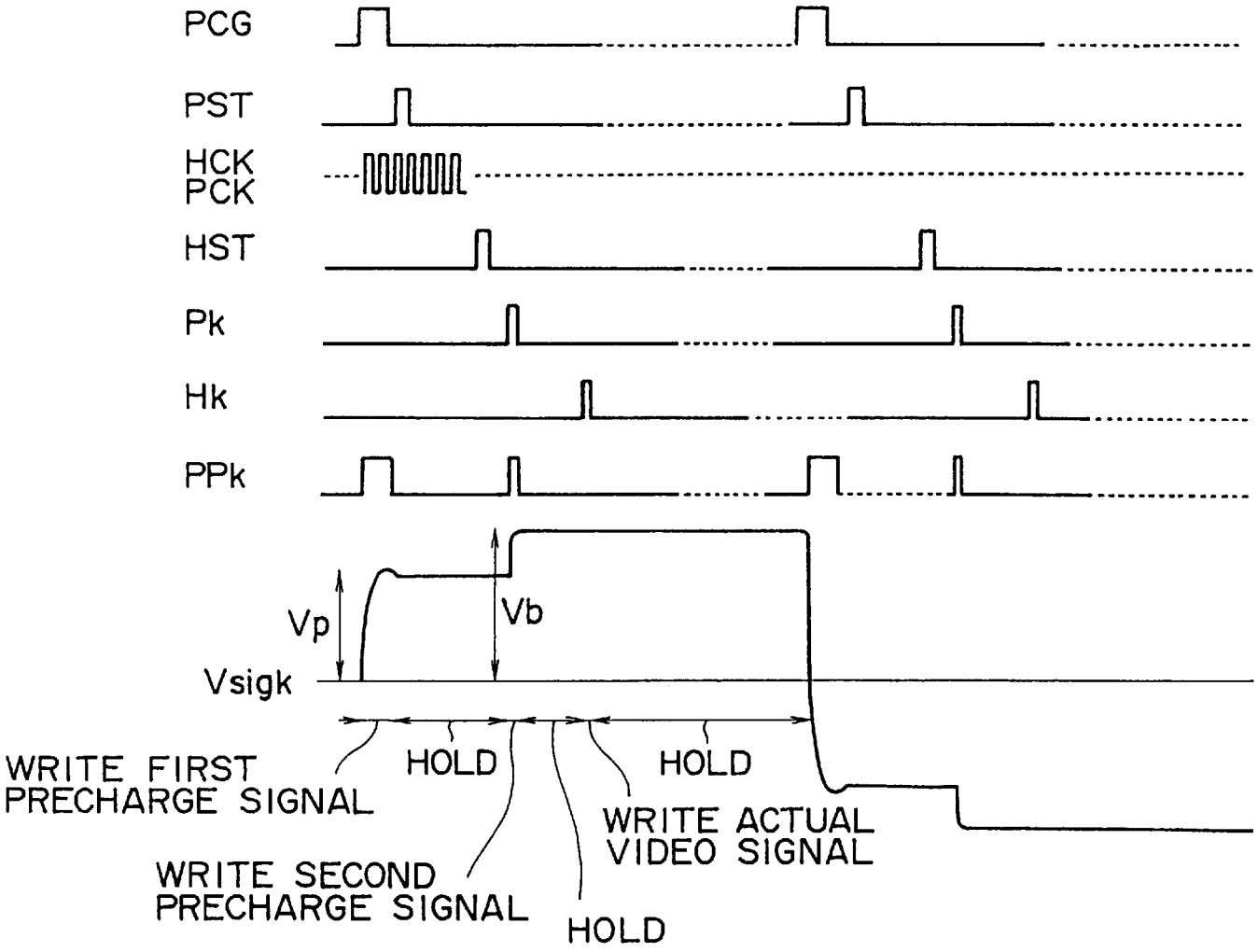
FIG. 3 is a timing chart for explaining the operation of the active matrix display device shown in FIG. 1.

Due to the two-step precharge executed as described above, the potential Vsigk of the kth signal line for example is changed as shown in FIG. 3. Initially the first precharge signal PBLK is written in response to PCG, and the signal line potential rises up to Vp. This potential is held for a while, and subsequently the second precharge signal is written in synchronism with Pk. In this embodiment, the second precharge signal has a potential Vb. After this level is held for a while, the actual video signal is written in synchronism with Hk. In this embodiment, the above actual video signal also has the potential Vb. Subsequently the signal line potential is held for a while, and then the operation proceeds to the next horizontal scanning period. Thus, in the present invention, the signal line potentials Vsig are raised simultaneously up to a gray level in synchronism with the control signal PCG. Thereafter the precharge video signal is written in synchronism with Pk prior to the timing of Hk at which the actual video signal is inputted. In short, when the actual video signal is written, there is induced a state where a potential difference of merely several hundred mV or so is to be compensated. Therefore, any potential fluctuation of the actual video signal at the charge and discharge time can be eliminated almost completely to consequently attain remarkable suppression of undesired vertical streaks observed heretofore in the prior art. The precharge vertical start signal PST and the precharge video signal are synchronized with each other. Similarly, the signal HST and the actual video signal also need to be synchronized with each other. The blanking signal PBLK included in the precharge video signal is used as the first precharge signal during the blanking period, and it is set to a gray level. The precharge video signal and the actual video signal are mutually the same in waveform except the blanking period. However, separate signal sources are provided individually for supplying the actual video signal and the precharge video signal. In case dot-sequential precharge alone is executed, some disadvantageous phenomenon such as shading is caused due to fluctuation of the gate lines and auxiliary capacitance lines at the time of dot-sequential scanning. In view of this point, simultaneous precharge is executed in the present invention prior to the dot-sequential scanning. And the control signal PCG is supplied externally for achieving this purpose. There are two periods when writing in one signal line, i.e., a dot-sequential precharge period and a dot-sequential actual video signal write period, whereby the on-time of each switch HSW is equivalently rendered double to consequently reduce the ghost as well. This is equivalent to that the video lines of the actual video signal are doubled.

Figure 4:
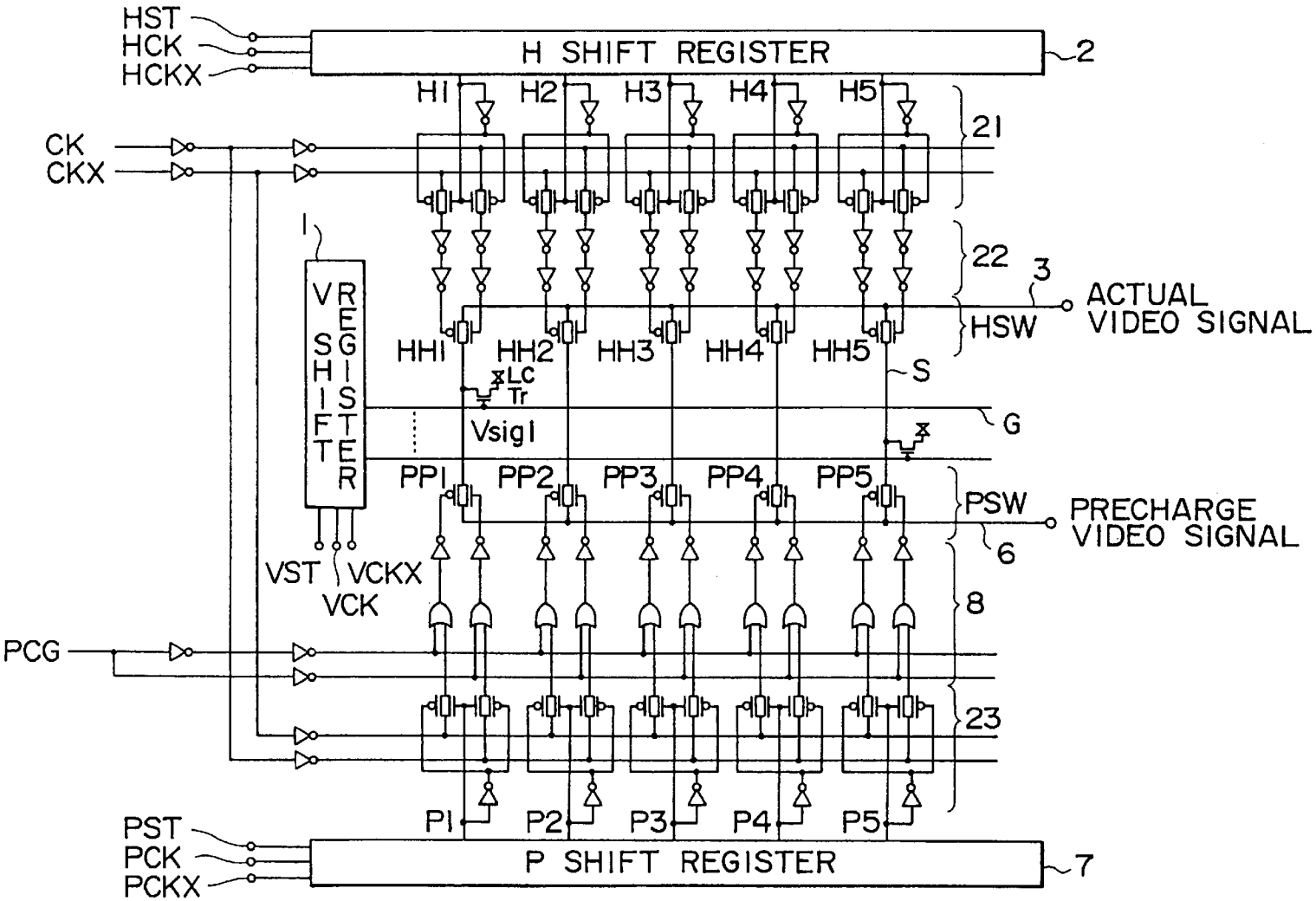
FIG. 4 is a circuit diagram showing a concrete configuration of the active matrix display device in FIG. 1.

FIG. 4 is a circuit diagram showing a concrete configuration of the active matrix display device in FIG. 1. For making it better understood with facility, any circuit components corresponding to those in FIG. 1 are denoted by like reference numerals or symbols. In this example, each switch HSW consists of a transmission gate element. Sampling pulses H1, H2, H3, . . . outputted sequentially from an H shift register 2 are transferred via a clock gate 21 and a buffer 22 to become signals HH1, HH2, HH3, . . . and so forth, which are then applied to the corresponding switches HSW respectively. For the purpose of driving the transmission gate elements, signals opposite in phase to HH are also applied thereto simultaneously. The clock gate 21 is turned on and off in response to the sampling pulses H, whereby CK and CKX inputted externally are sampled and then are supplied to the buffer 22. More specifically, in this embodiment, the switches HSW are on-off controlled not by directly using the sampling pulses H1, H2, H3, . . . , but by using the signals HH1, HH2, HH3, . . . which are obtained through selection of CK and CKX in accordance with the pulses H1, H2, H3, . . . and so forth. Since the pulses H1, H2, H3, . . . outputted from the H shift register 2 have some delay or distortion in the waveform thereof, such pulses are once transferred via the clock gate 21 instead of being used directly for on-off control of the switches HSW, so that waveform-shaped signals HH1, HH2, HH3, . . . are obtained. Since these signals HH1, HH2, HH3, . . . are produced on the basis of CK and CKX which have neither delay nor distortion, it is possible to perform precise on-off control of the switches HSW. Similarly, sampling pulses P1, P2, P3, . . . outputted from a P shift register 7 are used for on-off control of a clock gate 23, and then CK and CKX obtained via the gate 23 are used for on-off control of switches PSW. A gate 8 is existent between the clock gate 23 and the switches PSW, and PCG is added to each of PP1, PP2, PP3, . . . and so forth.

Referring finally to a timing chart of FIG. 5, the operation of the active matrix display device shown in FIG. 4 will be described in detail below. The control signal PCG is outputted during the blanking period, and its predetermined on-time corresponds to several dots (several bits), so that the first precharge signal can be written sufficiently in accordance with the signal PCG. CK, HCK and PCK are mutually the same in waveform, and similarly CKX, HCKX and PCKX are mutually the same in waveform. These signals are supplied from an external timing generator. PST is supplied externally after output of PCG, and subsequently HST is supplied with a predetermined phase difference. The P shift register 7 sequentially transfers PST in synchronism with PCK and PCKX, thereby outputting precharge sampling pulses P1, P2, P3, . . . and so forth. Similarly the H shift register 2 sequentially transfers HST in synchronism with HCK and HCKX, thereby sequentially outputting actual video signal sampling pulses H1, H2, H3, . . . and so forth. The clock gate 23 selectively passes CK and CKX therethrough in response to P1, P2, P3, . . . , and then supplies PP1, PP2, PP3, . . . to the switches PSW respectively. At this time, the OR gate 8 serves to add PCG to PP1, PP2, PP3, . . . and so forth. Meanwhile the clock gate 21 in the H shift register 2 selectively passes CK and CKX therethrough in response to H1, H2, H3, . . . , thereby producing final sampling pulses HH1, HH2, HH3, . . . and so forth. As obvious from the timing chart of FIG. 5, each pulse PCG for simultaneous precharge has an on-time corresponding to several bits, while each sampling pulse for dot-sequential precharge has a pulse width of one bit. In comparison therewith, each of the actual video signal sampling pulses has a pulse width of one bit. Generally the on-time of the switch PSW may be so determined as to correspond to a range from one to several bits, while the on-time of the switch HSW is determined to correspond merely to one bit, whereby it is rendered possible to achieve effective suppression of ghost observed heretofore as a problem in simultaneously sampling a plurality of bits.

Figure 5:
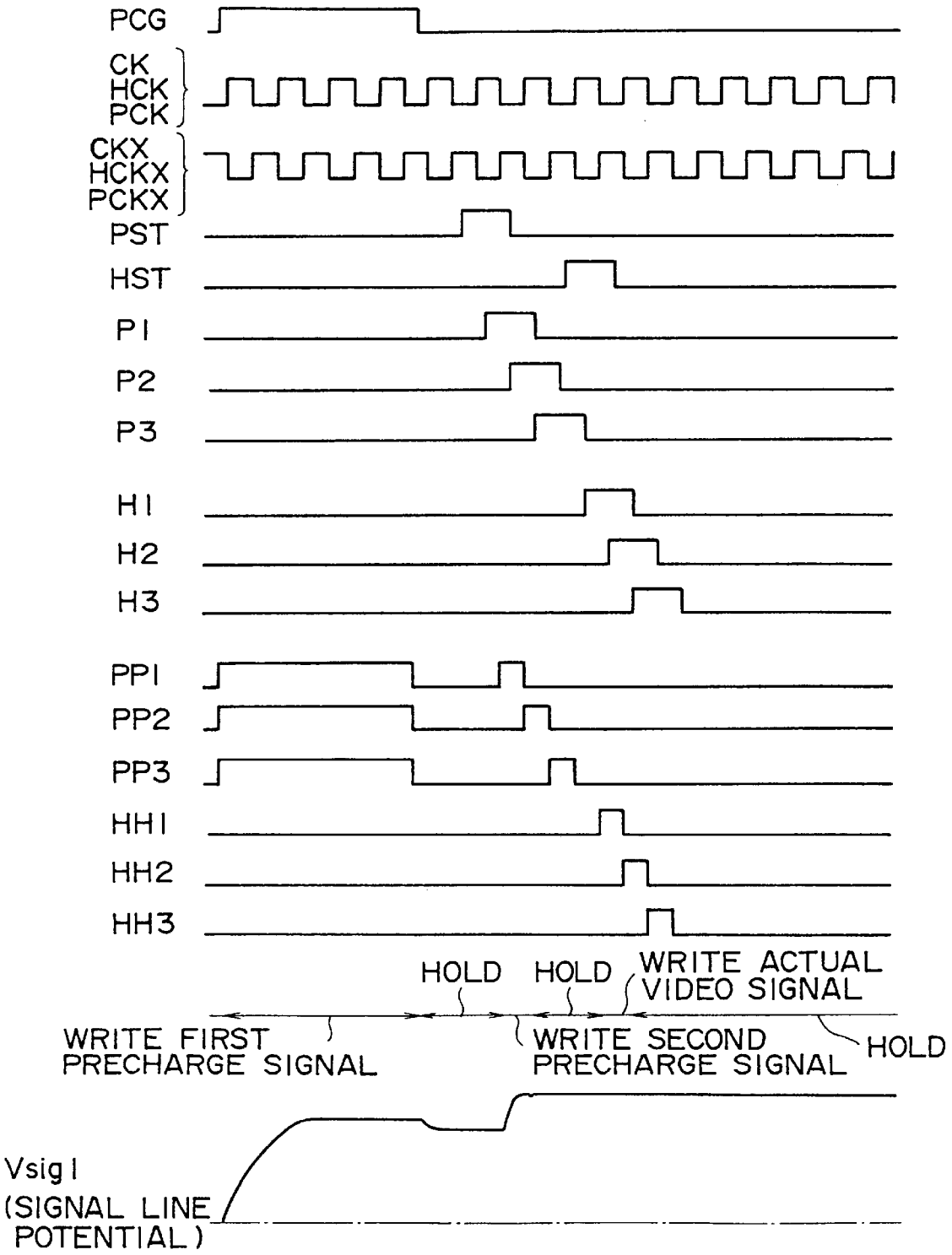
FIG. 5 is a timing chart for explaining the operation of the active matrix display device shown in FIG. 4.
Figure 6:
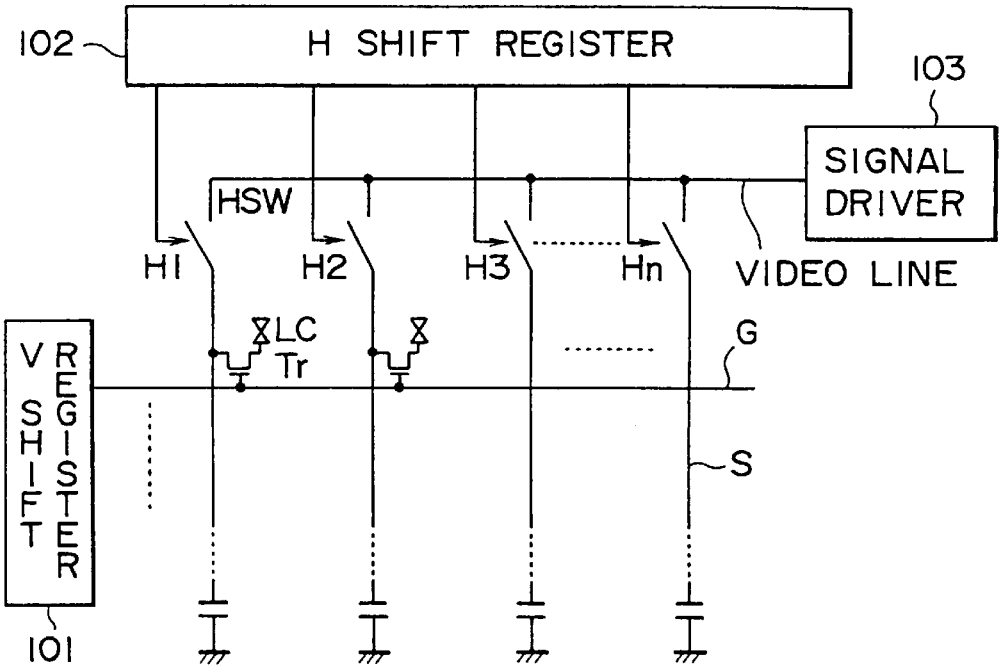
FIG. 6 (PRIOR ART)
FIG. 6 is a block diagram of an active matrix display device according to the related art.
Figure 7:
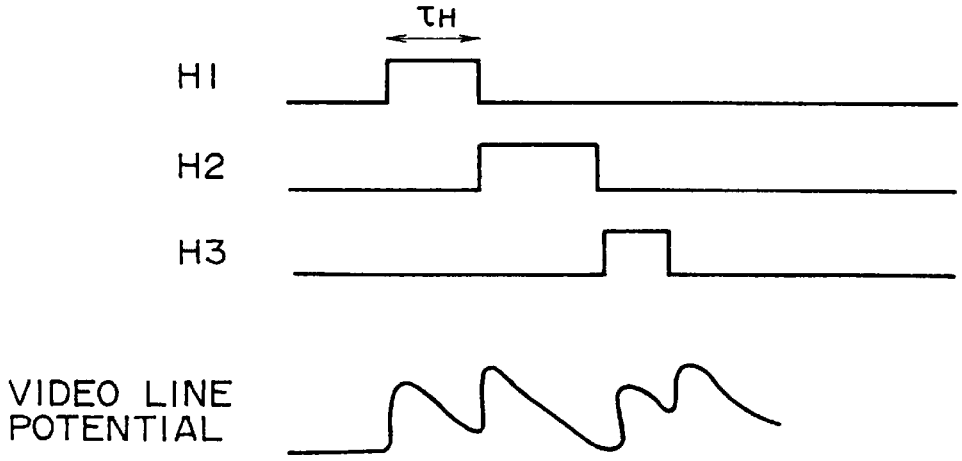
FIG. 7 (PRIOR ART)
FIG. 7 is a waveform chart for explaining the problems observed in the active matrix display device.

In the lowermost portion in the timing chart of FIG. 5, there are shown changes of the potential Vsig1 on the first signal line. The first precharge signal is written in response to PCG. This level is held for a while, and then the second precharge signal is written in response to PP1. Subsequently this level is held for a while, and the actual video signal is written in response to HH1. And the level written finally is held during one horizontal scanning period.

According to the present invention, as described hereinabove, first precharge is executed during a blanking period, and subsequently second precharge is executed dot-sequentially during a horizontal scanning period. Therefore, in the step of writing the actual video signal, the signal line potential has already reached the actual video signal potential level substantially completely, so that no fluctuation occurs in the signal potential to consequently diminish a fixed pattern of vertical streaks or the like. Further, due to the simultaneous precharge performed prior to the dot-sequential precharge, it becomes possible to eliminate any potential fluctuation that may otherwise be caused during the dot-sequential precharge. Consequently, complete dot-sequential precharge can be attained with solution of the known problem such as shading. In addition, since the on-time of each horizontal switch is equivalently doubled, there is achieved another advantage of reducing the ghost and deterioration of the resolution.

Although the present invention has been described hereinabove with reference to the preferred embodiment thereof, it is to be understood that the invention is not limited to such embodiment alone, and a variety of other modifications and variations will be apparent to those skilled in the art without departing from the spirit of the invention.

The scope of the invention, therefore, is to be determined solely by the appended claims.

What is claimed is:

1. An active matrix display device comprising row gate lines, column signal lines, matrix pixels disposed at intersections of said gate lines and signal lines, a vertical scanning circuit for line-sequentially scanning said gate lines and selecting pixels of one row during each horizontal scanning period, and a horizontal scanning circuit for sequentially sampling a video signal to the signal lines within each horizontal scanning period and writing the video signal dot-sequentially in the selected pixels of one row, said device comprising:

a precharge means for supplying a first precharge signal to at least one signal line during a blanking period which precedes the horizontal scanning period, and supplying a second precharge signal to said signal line prior to the sequentially applying a video signal during the horizontal scanning period, wherein the first precharge signal has a single polarity which is the same as the immediately following video signal during a single horizontal scan.

2. The active matrix display device according to claim 1, wherein said precharge means simultaneously supplies the first precharge signal having a predetermined potential to all the signal lines, and thereafter sequentially applies the second precharge signal having a waveform which is substantially the same as that of the video signal.

3. The active matrix display device according to claim 1, wherein said precharge means comprises a plurality of switch means respectively connected to ends of the signal lines, and a control means for executing on-off control of said switch means, said control means capable of executing simultaneous on-off control of said switch means during the blanking period and supplying the first precharge signal to each signal line, then executing sequential on-off control of said switch means during the horizontal scanning period and supplying the second precharge signal to each signal line.

4. A method of driving an active matrix display device which has row gate lines, column signal lines, matrix pixels disposed at intersections of said gate lines and signal lines, a vertical scanning circuit for line-sequentially scanning said gate lines and selecting pixels of one row during each horizontal scanning period, and a horizontal scanning circuit for sequentially sampling a video signal to the signal lines within each horizontal scanning period and writing the video signal dot-sequentially in the selected pixels of one row, said method comprising the steps of:

supplying a first precharge signal to at least one signal line during a blanking period which precedes the horizontal scanning period, wherein the first precharge signal has a single polarity which is the same as the immediately following video signal during a single horizontal scan; and sequentially supplying a second precharge signal to said signal line prior to the sequential sampling of the video signal lines during the horizontal scanning period.

5. The method according to claim 4, further comprising the steps of:

simultaneously supplying the first precharge signal having a predetermined potential to a plurality of signal lines; and thereafter sequentially supplying the second precharge signal whose waveform is substantially the same as that of the video signal to the plurality of signal lines.

6. The method according to claim 4, further comprising the steps of:

supplying the first precharge signal to each signal line during the blanking period through simultaneous on-of control of a plurality of switches connected to ends of the signal lines respectively; and supplying the second precharge signal to each signal line through sequential on-off control of said plurality of switches during the horizontal scanning period.

7. The active matrix display device according to claim 4, wherein said precharge means simultaneously supplies the first precharge signal having a predetermined potential to all the signal lines, and thereafter sequentially applies the second precharge signal having a waveform which is substantially the same as that of the video signal.

8. A method of driving an active matrix display comprising the steps of:

applying a first precharge signal to at least one signal line, wherein the first precharge signal has a single polarity which is the same as the immediately following video signal during a single horizontal scan;

applying a second precharge signal to the signal line before applying a video signal; and thereafter applying a video signal to the signal line.

9. The method of driving an active matrix display of claim 8, further comprising a step of simultaneously applying the first precharge signal to each one of a plurality of signal lines.

10. The method of driving an active matrix display of claim 8, wherein the step of applying the first precharge signal comprises applying a signal set to a grey level.

11. The active matrix display device according to claim 8, wherein said precharge means simultaneously supplies the first precharge signal having a predetermined potential to all the signal lines, and thereafter sequentially applies the second precharge signal having a waveform which is substantially the same as that of the video signal.

12. An active matrix display device comprising:

row gate lines;

column signal lines;

matrix pixels disposed at intersections of said gate lines and signal lines;

a vertical scanning circuit for line-sequentially sampling a video signal to the signal lines within each horizontal scanning period and writing the video signal in the selected pixels of one row;

means for reversing the polarity of said video signal with respect to a potential;

a precharge means for supplying a first precharge signal to at least one signal line during a blanking period which precedes the horizontal scanning period, and supplying a second precharge signal to said signal line prior to sequentially applying the video signal during the horizontal scanning period, said first and second precharge signals each respectively having the same polarity of the corresponding reversed video signals.

13. An active matrix display device as claims in claim 12, wherein said first precharge signal is supplied to all the signal lines simultaneously.

14. An active matrix display as claimed in claim 12, wherein said video signal is reversed during a horizontal scanning period.

15. An active matrix display device as claimed in claim 12, wherein said precharge means comprises a plurality switches respectively connected to ends of the signal lines, and a control means for executing on-off control of said switches.

16. An active matrix display device as claimed in claim 15, wherein said control means is capable of executing simultaneous on-off control of said switches during the blanking period and supplying the first precharge signal to each signal line, then executing sequential on-off control of said switches during the horizontal scanning period and supplying the second precharge signal to each signal line.

17. An active matrix display device as claimed in claim 12, wherein said first precharge signal has a predetermined potential and said second precharge signal has a predetermined potential and said second precharge signal has a waveform which is substantially the same as that of the video signal.

* * * * *